US008479910B2

(12) United States Patent
Rennie et al.

(10) Patent No.: US 8,479,910 B2
(45) Date of Patent: Jul. 9, 2013

(54) REMOVABLE MEDIA CONTAINER

(75) Inventors: Michael Rennie, Fife (GB); Ken Peters, Dundee (GB); Gordon Burke, Angus (GB)

(73) Assignee: NCR Corporation, Duluth, GA (US)

( * ) Notice: Subject to any disclaimer, the term of this patent is extended or adjusted under 35 U.S.C. 154(b) by 218 days.

(21) Appl. No.: 12/868,863

(22) Filed: Aug. 26, 2010

(65) Prior Publication Data

US 2012/0048877 A1 Mar. 1, 2012

(51) Int. Cl.
*G07D 11/00* (2006.01)

(52) U.S. Cl.
USPC ..... 194/350

(58) Field of Classification Search
USPC ..... 271/3.03, 3.04, 145, 207, 213, 214; 414/789.6, 789.9; 312/34.7, 50, 188; 235/379; 209/534; 902/9, 10, 11, 12, 13; 109/53; 232/1 D; 194/206, 350
See application file for complete search history.

(56) References Cited

U.S. PATENT DOCUMENTS

2003/0047861 A1* 3/2003 Minamishin et al. ..... 271/10.01
2003/0173183 A1* 9/2003 Katou et al. ..... 194/206

* cited by examiner

*Primary Examiner* — Mark Beauchaine
(74) *Attorney, Agent, or Firm* — Paul W. Martin

(57) ABSTRACT

A removable media container for use in a media dispenser is described. The media container comprises: a diverter entrance for receiving diverted media items prior to stacking of the media items; a non-present stack entrance for receiving a stack of media items subsequent to stacking of the media items but prior to presentation of the stack of media items to a customer; and a present stack entrance for receiving a stack of media items subsequent to presentation of the stack of media items to a customer.

14 Claims, 10 Drawing Sheets

FIG. 1
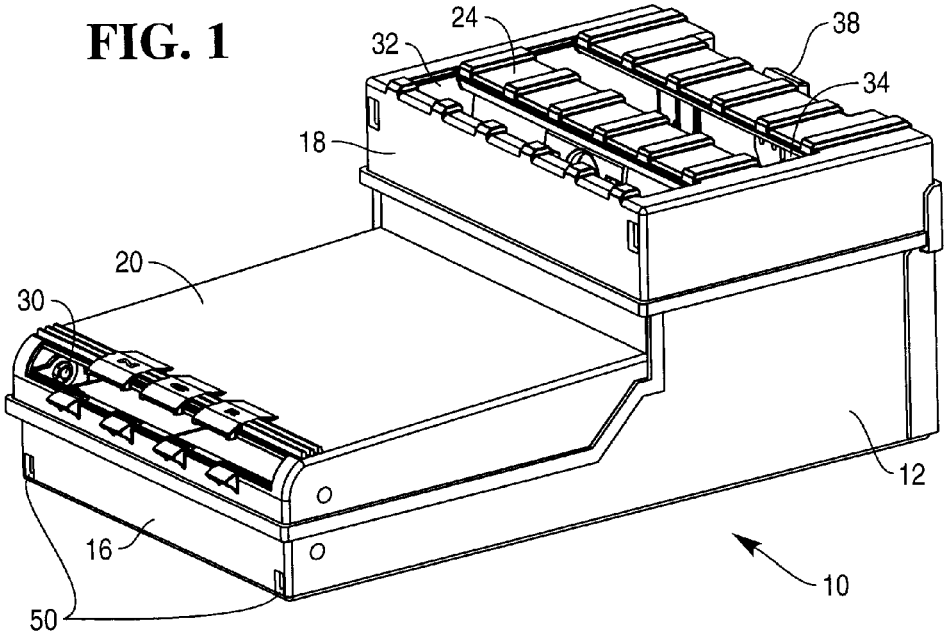
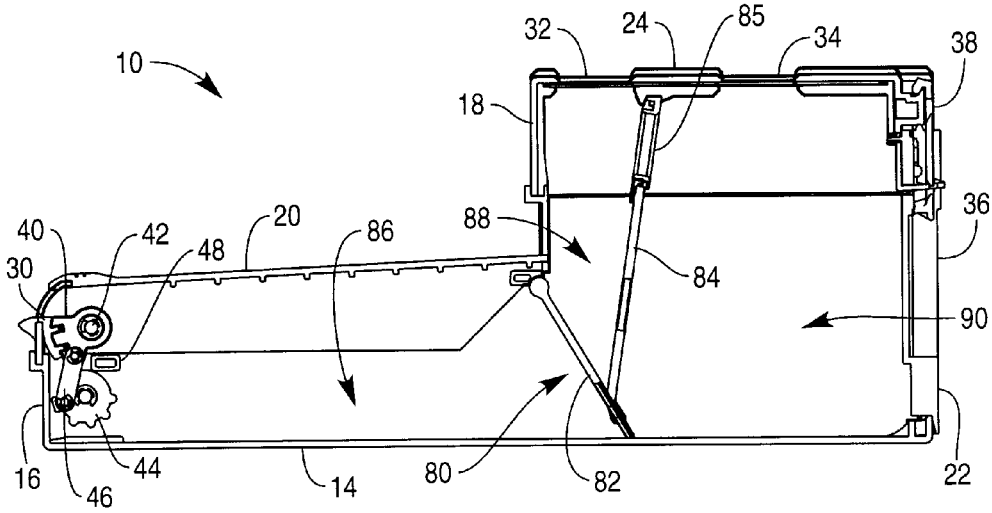
FIG. 2

FIG. 3A
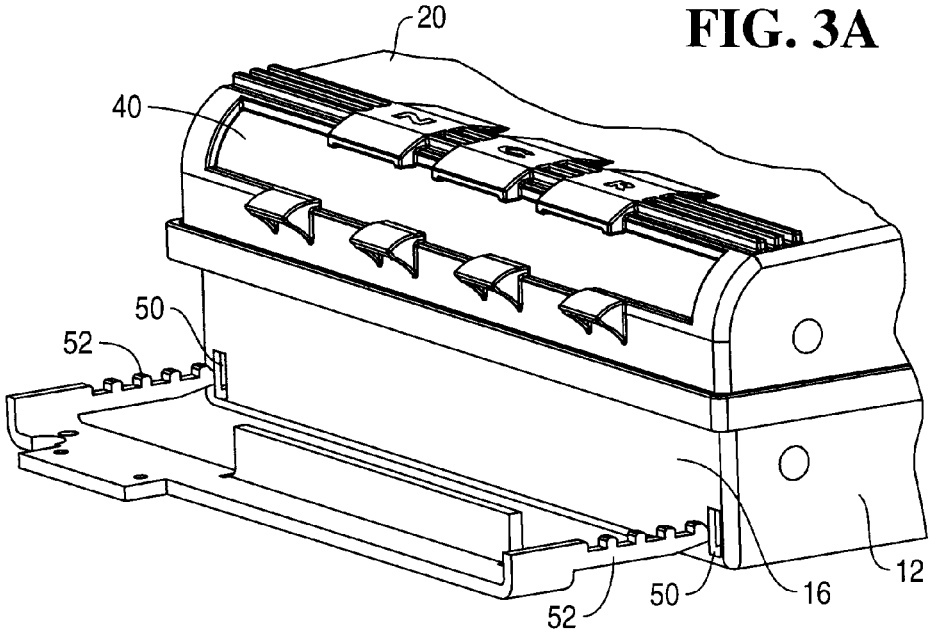
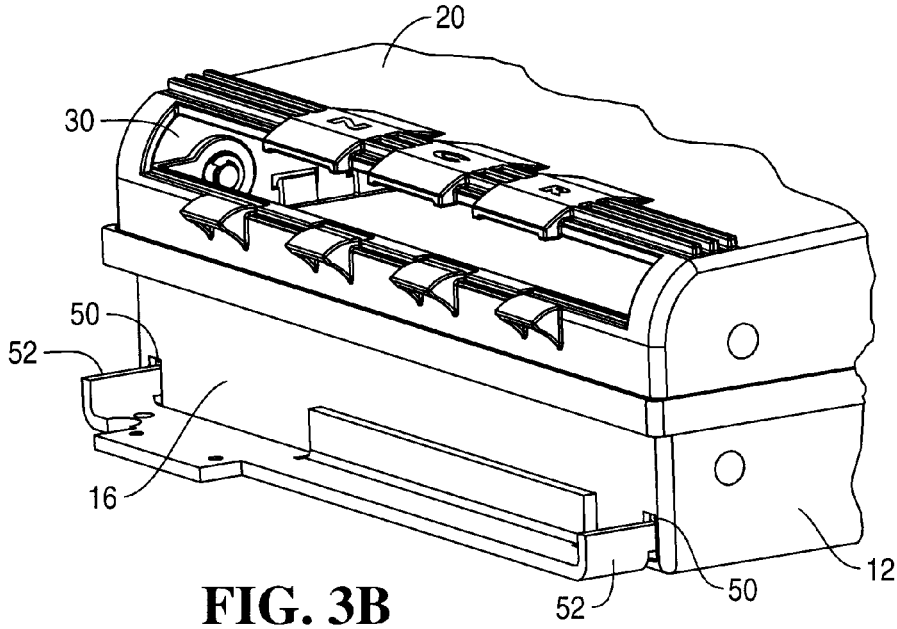
FIG. 3B

REMOVABLE MEDIA CONTAINER

FIELD OF INVENTION

The present invention relates to improvements in or relating to a removable media container.

BACKGROUND OF INVENTION

One type of removable media container is a purged media container. A purged media container is removably located within a self-service terminal (SST), such as an automated teller machine (ATM), and receives media items (such as banknotes) that are not presented to a customer and/or are presented to a customer but are not removed by that customer.

There are a variety of reasons for media items being sent to a purged media container.

In SSTs that have a spray presenter or a bunch presenter, if multiple media items are picked in a single operation instead of a single media item, then those multiple media items are typically transferred to the purged media container.

In an SST that has a bunch presenter, any error in creating a bunch of media items may lead to the bunch being sent to the purged media container. For example, if insufficient media items are available to create the complete bunch, if there is a temporary power failure during bunch creation, or the like. Furthermore, bunch presenter SSTs may also retract a bunch of media items presented to a customer if that customer does not remove those media items. The retracted media items are transferred to the purged media container.

One problem with purged media containers is that media items are stored in a bulk area, so it is difficult to associate media items with a particular transaction, which makes reconciliation difficult. One type of fraud involves a customer removing some but not all of the media items presented during a transaction. Those media items that were not removed are typically transferred to the purged media container. However, it is difficult to be certain whether all of the media items from a transaction were delivered to the purged media container because there could be multiple media items present because of, for example, multiple media items being picked simultaneously then purged.

It would be desirable to provide an improved purged media container. It would also be desirable to provide a purged media container that obviates or mitigates one or more of the above disadvantages or other disadvantages associated with media containers.

SUMMARY OF INVENTION

Accordingly, the invention generally provides methods, systems, and apparatus for an improved media container.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a removable media container for use in a media dispenser, the media container comprising:

a diverter entrance for receiving diverted media items prior to stacking of the media items;

a non-present stack entrance for receiving a stack of media items subsequent to stacking of the media items but prior to presentation of the stack of media items to a customer; and a present stack entrance for receiving a stack of media items subsequent to presentation of the stack of media items to a customer.

The removable media container may further comprise: a diverter entrance shutter pivotably mounted within the container and biased to a closed position; a detent to maintain the diverter entrance shutter in the closed position; a channel for receiving a tine when the container is mounted in a media presenter; and a cog coupled to the diverter entrance shutter by a link arm, and aligned with the channel so that when a tine is received in the channel, the cog is operable to drive the diverter entrance shutter to an open position.

The removable media container may further comprise: a second channel, parallel to the first channel, and for receiving a tine when the container is mounted in a media presenter; and a second cog coupled to the diverter entrance shutter by a second link arm, and aligned with the second channel so that when a tine is received in each channel, the cogs are operable to drive the diverter entrance shutter to an open position.

Each of the non-present stack entrance and the present stack entrance may comprise an aperture, and the non-present and present stack entrances may be separated by a distance approximately equal to the width of each of the non-present and present apertures.

The container may further comprise a frame, slideably mounted in an upper surface of the container, the frame defining a non-present slot dimensioned to correspond to the width of the non-present aperture defined on each side by plates, one of the plates being at least as wide as the width of the non-present aperture so that when the plate is biased to a closed position, both of the non-present and present apertures are closed by the frame, but when the frame is urged to an open position, the non-present aperture aligns with the non-present slot, and an edge of the frame is located beneath the area between the non-present aperture and the present aperture.

A pawl may be pivotably coupled to the frame by a pivot shaft, so that a tine may urge the pawl downwards, then further urging of the pawl by the tine may urge the frame rearwards. A detent may be provided to stop the frame from moving rearwards beyond an end position.

The media container may include an access door opposite the diverter entrance. The access door may be closed by a clasp.

The media container may comprise a split-level housing defining a lower surface, a middle upper surface extending opposite a first part of the lower surface, and an upper surface extending opposite a second part of the lower surface, and the container may further comprise a divider coupled between the middle upper surface and the lower surface, separating a diverter compartment defined by the lower surface and the middle upper surface, from a purge compartment defined by the lower surface and the upper surface.

The media container may further comprise a three-way divider comprising (i) a first portion coupled between the middle upper surface and the lower surface, and (ii) a second portion coupled between the first portion and the upper surface at a point between the non-present entrance and the present entrance, thereby providing a diverter compartment, a present purge compartment, and a non-present purge compartment.

The first portion may be pivotably coupled to the middle upper surface and may have a snap-fit coupling to the lower surface, so that the first portion can be pivoted upwards (towards the middle upper surface) to provide access to the diverter compartment.

The second portion may be removably coupled to the first portion. The second portion may be hingeably coupled to the first portion and may have a snap-fit coupling to the upper surface so that the second portion can be hinged downwards towards the lower surface to provide access to the present purge compartment.

The second portion may be removable to create a single purge compartment instead of the present purge compartment and the non-present purge compartment.

The media container may further comprise: an access door opposite the diverter entrance and operable to close an access door aperture; and a warning mechanism operable to prevent the access door from closing in the event that the second portion is not coupled to the upper surface.

The second portion may comprise a length exceeding the distance between (i) the access door aperture, and (ii) the point at which the second portion is coupled to the first portion, so that if the second portion is not coupled to the upper surface (for example, via the snap-fit coupling) then the second portion will protrude beyond the access door aperture so that the access door cannot be located in position. This should serve as an indication to a replenisher that the media container is not correctly configured.

According to a second aspect there is provided a media presenter comprising:

a chassis including a nose coupled thereto, and including (i) a presenting end distal from the chassis, and (ii) a presenting track extending from the chassis to the presenting end;

a carriage mounted on the presenting track for movement therealong, and comprising a carriage body coupled to a carriage plate, the carriage plate including a cam follower, the carriage being operable to transport the bunch of media items out of either (i) a purge end or (ii) a loading end opposite the purge end;

a cam block defining a cam track and being operable to engage with the cam follower to move the carriage between an open position at which media items can be placed on the carriage plate, and a closed position for clamping media items between the carriage plate and the carriage body;

wherein the carriage is moveable between (i) a present position, at which the bunch of media items is presented to a customer, (ii) a present purge position, at which the purge end aligns with a present stack entrance, and (iii) a non-present purge position, at which the purge end aligns with a non-present stack entrance.

The present position, the present purge position, and the non-present purge position may be longitudinally spaced along the presenting track.

According to a third aspect there is provided a method of transporting a bunch of media items located in a carriage to a media container, the method comprising:

ascertaining that a bunch of media items is to be transported to a media container; and either:

(i) in the event that the bunch of media items has not been presented to a customer, (a) transporting the carriage to a non-present purge position; and (b) ejecting the bunch of media items through a non-present stack entrance in a non-present purge compartment; or (ii) in the event that the bunch of media items has been presented to a customer, (a) transporting the carriage to a present purge position, spatially separated from the non-present purge position, and (b) ejecting the bunch of media items through a present stack entrance in a present purge compartment.

The present purge position may be laterally offset from the non-present purge position along a presenting track.

This aspect has the advantage that bunches of media items that have been presented to a customer and then retracted and purged are stored in a separate compartment to bunches of media items that are purged without ever having been presented to a customer.

According to a fourth aspect there is provided a media presenter comprising: a chassis including a nose coupled thereto, the chassis and nose including (i) a presenting end distal from the chassis, and (ii) a presenting track extending from the chassis to the presenting end; and a carriage mounted on the presenting track for movement therealong, and comprising a carriage body coupled to a carriage plate by a linkage, the carriage plate being movable between an open position at which media items can be placed on the carriage plate, and a closed position for clamping media items between the carriage plate and the carriage body.

The carriage body may comprise: a carriage chassis; an upper plate mounted on the carriage chassis and resiliently biased towards the carriage plate; an upper transport section mounted to the upper plate and including a plurality of stretchable belts; and a motor mounted on the carriage chassis and above the upper plate.

The carriage plate may further comprise: a lower transport section including a plurality of stretchable belts, and the motor is operable to control the upper transport section and the lower transport section to transport a bunch of media items out of either a pick end of the carriage or a handle end of the carriage, opposite the pick end.

The motor may be operable to transport the bunch of media items out of (i) the handle end when the bunch of media items is to be transported to a purge container, and (ii) the pick end when the bunch of media items is to be presented to a customer.

The linkage may comprise (i) a first pair of link arms coupling the carriage plate to the carriage body at a media entrance end, and (ii) a second pair of link arms coupling the carriage plate to the carriage body at a non-entrance end opposite the entrance end.

The motor may be mounted to the chassis at a mounting point that is distal from the media entrance end of the carriage and proximal to the non-entrance end of the carriage.

The carriage chassis may be reversible so that, when the carriage chassis is reversed, the motor mounting point is proximal to the media entrance end of the carriage and distal from the non-entrance end of the carriage.

The media presenter may further comprise a registration device coupled to the chassis and for maintaining media items placed on the carriage plate in alignment when the carriage plate is in the open position.

The registration device may comprise a plurality of fingers extending above the carriage plate when the carriage plate is in the open position, the plurality of fingers being (i) pivotably coupled to the chassis, and (ii) resiliently biased towards the carriage plate.

The carriage plate may further comprise a bumper at the media entrance end arranged to deflect the plurality of fingers when the carriage plate is moved to the open position to allow media items to be transported over the plurality of fingers and placed on the carriage plate.

The fingers may be disposed and arranged so that when fully deflected by the bumper, the fingers provide a registration edge against which media items rest after being placed on the carriage plate.

The carriage plate may traverse a closure path when moved back to the closed position, and the fingers may urge against the bumper and maintain the media items as a stack in registration on the carriage plate during a first portion of the closure path, and the fingers may cease contact with the bumper and the media item stack during a second portion of the closure path.

The linkage may move the carriage plate from (i) a relatively steep angle, at which gravity causes the media items to slip, during the first portion of the closure path to (ii) a relatively shallow angle, at which gravity does not cause the media items to slip, during the second portion of the closure path.

According to a fifth aspect there is provided a method of presenting a bunch of media items from a carriage to a customer, the method comprising: moving a carriage along a presenting track until the carriage reaches a loading position; opening the carriage to reveal an upper surface of a carriage plate spatially separated from a carriage body; deflecting a registration edge to enable an exit portion of a media item transport to align with the carriage plate; transporting individual media items onto the upper surface of the carriage plate to form a bunch of media items; closing the carriage to pinch the bunch of media items between the upper surface of the carriage plate and a lower surface of the carriage body; moving the carriage along the presenting track until the carriage reaches a present position; and transporting the bunch of media items from the carriage to a customer.

The step of deflecting a registration edge may include the sub-step of: using the carriage plate to deflect a plurality of resilient fingers as the carriage plate is moved to the open position.

The media items may comprise banknotes, tickets, coupons, or the like.

According to a sixth aspect there is provided a media dispenser comprising a pick unit coupled to the media presenter of the second aspect.

According to a seventh aspect there is provided a self-service terminal incorporating the media dispenser of the sixth aspect. The self-service terminal may be an automated teller machine.

According to an eighth aspect there is provided a method of presenting a bunch of media items to a customer, the method providing: moving a carriage along a presenting track until the carriage reaches a loading position; guiding a cam follower on the carriage in a first direction along a cam track to open the carriage and reveal an upper surface of a carriage plate spatially separated from a carriage body; transporting individual media items onto the upper surface of the carriage plate to form a bunch of media items; guiding the cam follower on the carriage in a second direction, opposite the first direction, along the cam track to close the carriage and pinch the bunch of media items between the upper surface of the carriage plate and a lower surface of the carriage body; moving the carriage along the presenting track until the carriage reaches a present position; and transporting the bunch of media items from the carriage to a customer.

The method may comprise the further step of using the carriage plate to deflect a plurality of resilient fingers as the carriage plate is moved to the open position.

The method may comprise the further step of maintaining the transported individual media items in registration on the upper surface of the carriage plate by using the resilient fingers to provide an edge against which media items rest after being placed on the upper surface of the carriage plate.

The method may comprise the further steps of: detecting that one or more media items in the bunch of media items have not been removed by the customer; rotating the cam block to a ledge position at which a lead-in track to the cam track is replaced by a ledge track so that the cam follower is not guided along the cam track when the carriage is at the loading position; moving the carriage along the presenting track from the present position, beyond the loading position, to a present purge position; and transporting the remaining media items out of the carriage and into a purged media container.

According to a ninth aspect there is provided a controller programmed to implement the steps of the third aspect.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

BRIEF DESCRIPTION OF THE DRAWINGS

FIG. 1 is a simplified perspective view of a media container according to one embodiment of the present invention;

FIG. 2 is a side view of the media container of FIG. 1, with one sidewall removed for clarity;

FIG. 3A is a perspective view of a lower front part of the media container of FIG. 1 approaching part (lower toothed tines) of a media dispenser;

FIG. 3B is a perspective view of the lower front part of the media container shown in FIG. 3A engaging with the lower toothed tines of FIG. 3A;

Figure 4A:
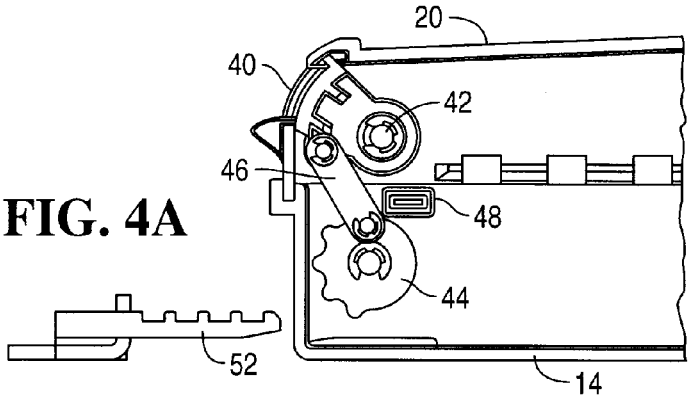
FIGS. 4A to 4D are side sectional views (without any shading) showing the lower front part of the media container and the lower toothed tines of the media dispenser at different positions between disengaged and engaged.

It should be appreciated that some of the drawings provided are based on computer renderings from which actual physical embodiments can be produced. As such, some of these drawings contain intricate details that are not essential for an understanding of these embodiments but will convey useful information to one of skill in the art. Therefore, not all parts shown in the drawings will be referenced specifically. Furthermore, to aid clarity and to avoid numerous leader lines from cluttering the drawings, not all reference numerals will be shown in all of the drawings. In addition, some of the features are removed from some views to further aid clarity.

DETAILED DESCRIPTION

Reference is first made to FIGS. 1 and 2, which are simplified perspective and side views respectively of a removable media container 10 (in the form of a purged banknote container).

The purged banknote container 10 comprises a split-level housing 12 defining a lower surface 14, a lower front surface 16 transverse to, and extending upwards from, the lower surface 14, an upper front surface 18 transverse to the lower surface 14, a middle upper surface 20 connecting the lower front surface 16 to the upper front surface 18, a rear surface 22 extending upwards from the lower surface 14 to an upper surface 24, which connects the upper front surface 18 to the rear surface 22.

The lower front surface 16 defines a diverter entrance 30. The upper surface 24 defines a present stack entrance 32 and a non-present stack entrance 34, in the form of parallel slots. An access door 36 is provided to close an access aperture in the rear surface 22, and the access door 36 is coupled to the rear surface by a plastic clasp 38.

The diverter entrance 30 is closed by an arcuate entrance shutter 40 pivotably coupled to a pair of shutter shafts 42. A pair of cogs 44 are coupled to the entrance shutter 40 by a pair of link arms 46, and a pair of detents 48 are provided to prevent the link arms 46 from being forced backwards by an attempt to force the arcuate entrance shutter 40 open. The split-level housing 12 defines a pair of channels 50 extending beneath the cogs 44.

Reference will now also be made to FIGS. 3A and 3B, which are perspective views showing the lower front surface 16 relative to a pair of lower toothed tines 52 mounted in a banknote dispenser (not shown). The purged banknote container 10 can be removably inserted into this banknote dispenser. As the purged banknote container 10 is inserted into this banknote dispenser, the toothed tines 52 align with the pair of channels 50.

Reference will now also be made to FIGS. 4A to 4D, which are side sectional views (without any shading) showing the pair of toothed tines 52 at four different stages of engagement with the cogs 44.

In FIG. 4A, the toothed tines 52 have not entered the channels 50, so the arcuate entrance shutter 40 is blocking the diverter entrance 30, and the link arms 46 are resting against the detents 48 to prevent the arcuate entrance shutter 40 from being forced open.

Figure 4B:
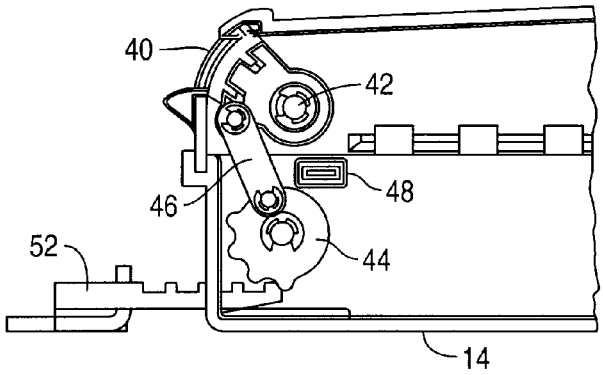

In FIG. 4B, the purged banknote container 10 has been inserted further into the dispenser, so that the toothed tines 52 have now entered the channels 50, and a leading tooth on each of the toothed tines 52 engages with a lower tooth on each of the cogs 44, thereby causing the cogs 44 to rotate counter-clockwise. This causes the link arms 46 to start pulling down on the arcuate entrance shutter 40.

Figure 4C:
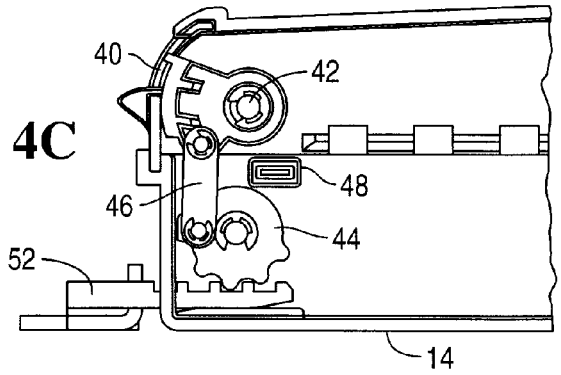

In FIG. 4C, the purged banknote container 10 has been inserted almost completely into the dispenser, so that the toothed tines 52 have now caused the cogs 44 to rotate almost fully, which, via the link arms 46, have pulled the arcuate entrance shutter 40 down towards the fully open position.

Figure 4D:
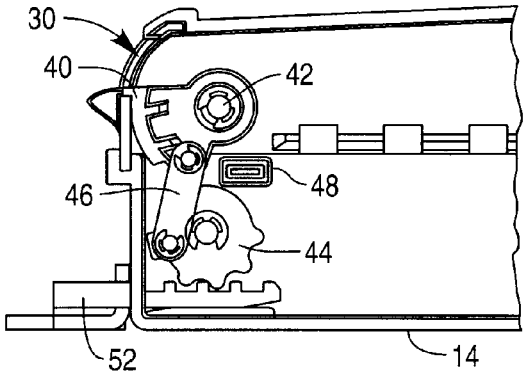

In FIG. 4D, the purged banknote container 10 has been inserted completely into the dispenser, so that the toothed tines 52 have now caused the cogs 44 to rotate fully, which, via the link arms 46, have pulled the arcuate entrance shutter 40 down to the fully open position, revealing the diverter entrance 30.

When the purged banknote container 10 is removed from the dispenser, then the cogs 44 are rotated clockwise by the toothed tines 52 to return the arcuate entrance shutter 40 to the closed position. At the closed position, the arcuate entrance shutter 40 fully closes the diverter entrance 30.

Figure 5A:
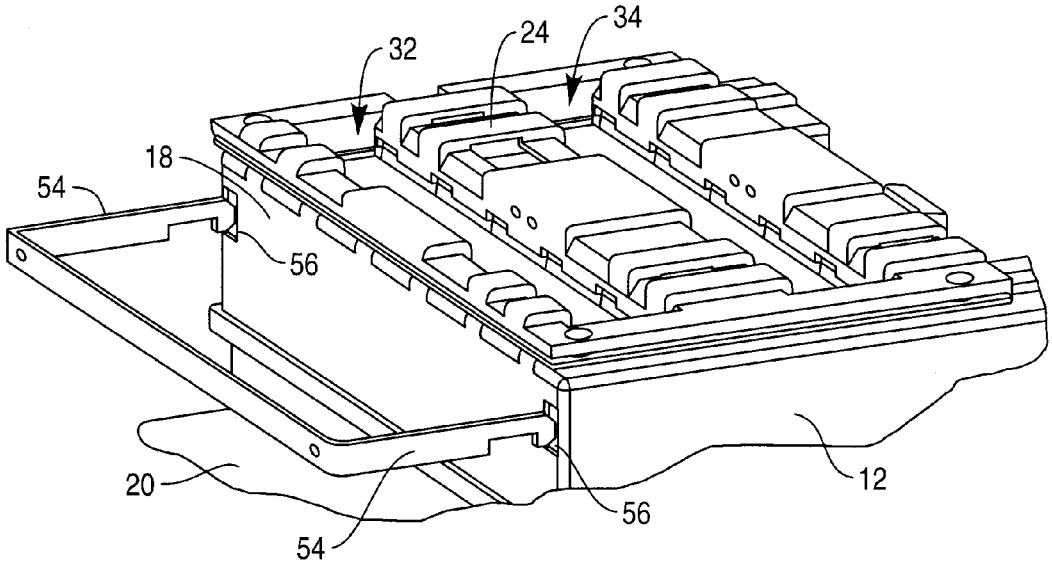
FIG. 5A is a perspective view of an upper front part of the media container of FIG. 1 approaching part (upper engaging tines) of a media dispenser.
Figure 5B:
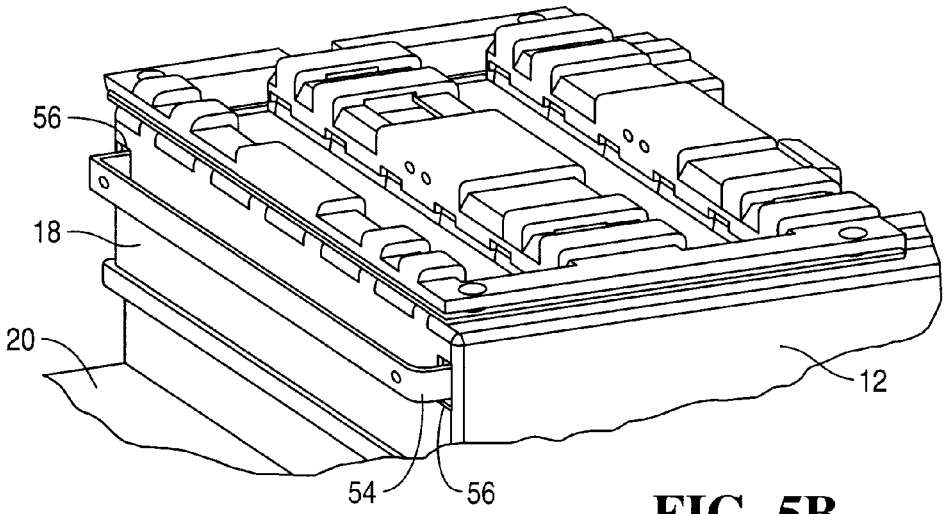
FIG. 5B is a perspective view of the upper front part of the media container engaging with the upper engaging tines of FIG. 5A.

Reference will now be made to FIGS. 5A and 5B, which are perspective views showing the upper front surface 18 of the purged banknote container 10 approaching (FIG. 5A) and engaging with (FIG. 5B) a pair of upper tines 54 of the dispenser.

The upper front surface 18 defines a pair of upper channels 56 in registration with the pair of upper tines 54 when the purged banknote container 10 is inserted into the dispenser.

Reference will now also be made to FIGS. 6A to 6E, which are side sectional views (without any shading) showing the pair of upper tines 54 at five different stages of engagement with a multi-slot closure mechanism 58 within the purged banknote container 10. Many of the components referenced below occur in pairs, but only one of them is visible in FIGS. 6A to 6E because the drawings are sectional drawings.

The multi-slot closure mechanism 58 comprises: a pair of pawls 60, an n-shaped frame 62 to which the pawls 60 are coupled by pivot shafts 64; urging members 66, in the form of a pair of leaf springs, a pair of rods 68 that are urged upwards by the leaf springs 66, and a pair of detent blocks 70 that provide upper detent surfaces 71 to prevent the pawls 60 from being moved rearwards. The pawls 60 are offset laterally from the detent blocks 70, but the pair of rods 68 extend laterally from the pawls 60 so that they can engage with the detent blocks 70.

Figure 6A:
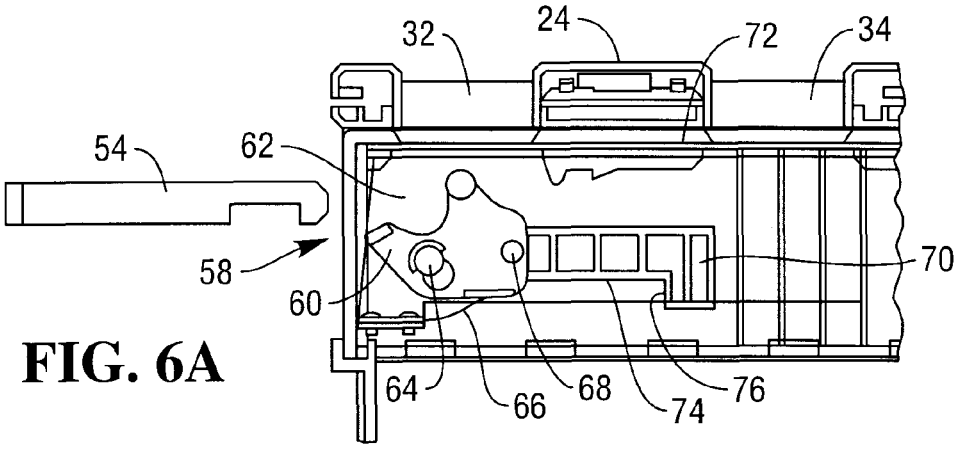
FIGS. 6A to 6E are side views showing the upper front part of the media container and the upper engaging tines of the media dispenser at different positions between disengaged and fully engaged.

A returning spring (not shown) is coupled to the n-shaped frame 62 to urge the n-shaped frame 62 to a closed position, as shown in FIG. 6A. The n-shaped frame 62 defines a non-present aperture 72 in an upper surface thereof. When in the closed position, the non-present aperture 72 is located between the present stack entrance 32 and the non-present stack entrance 34, so that both of these entrances 32,34 are closed by the upper surface of the n-shaped frame 62.

Figure 6B:
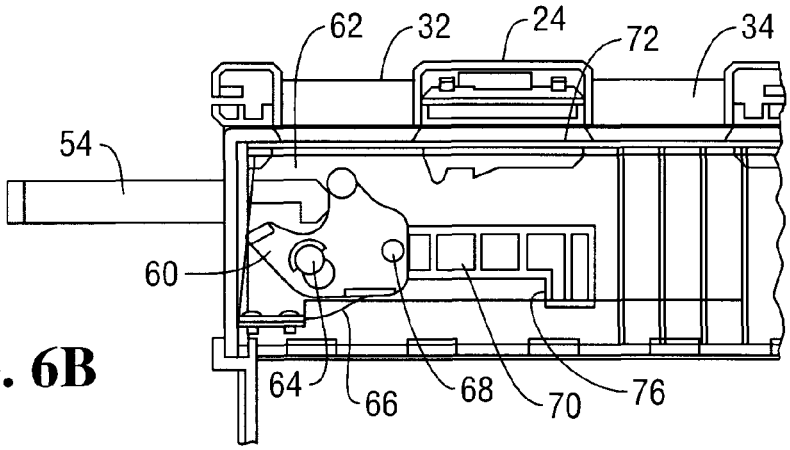

In FIG. 6B, the purged banknote container 10 has been partially racked in so that the pair of upper tines 54 has entered into the upper channels 56, and leading edges of the upper tines 54 engage with the pawls 60.

Figure 6C:
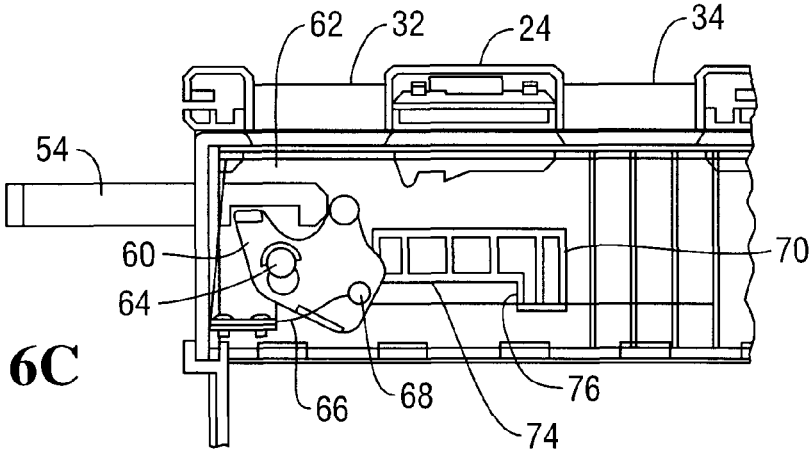

In FIG. 6C, the purged banknote container 10 has been further racked in so that the pair of upper tines 54 has moved further inside the upper channels 56 and the leading edges of the upper tines 54 having pivoted the pawls 60 downwards. This leaves the rods 68 clear of the detent blocks 70, thereby allowing the pawl 60 and n-shaped frame 62 to be pushed rearwardly by the upper tines 54.

Figure 6D:
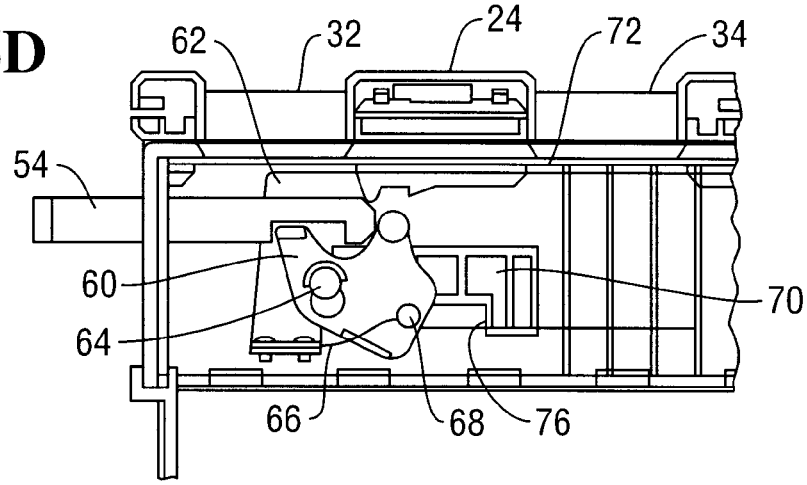

In FIG. 6D, the purged banknote container 10 has been almost completely racked in so that the pair of upper tines 54 has moved the pawl 60 and n-shaped frame 62 rearwards, partially opening the present stack entrance 32 and the non-present stack entrance 34. The leaf springs 66 act on the rods 68 to maintain them in contact with mid-lower surfaces 74 of the detent blocks 70.

Figure 6E:
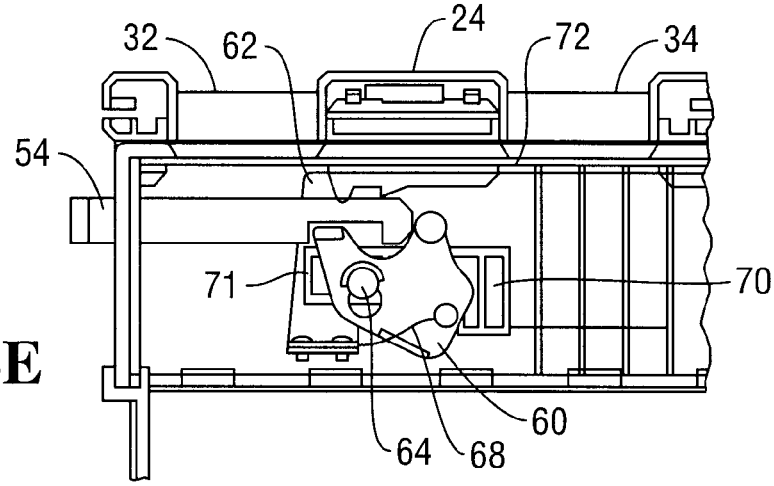

In FIG. 6E, the purged banknote container 10 has been completely racked in so that the pair of upper tines 54 has moved the pawl 60 and n-shaped frame 62 rearwards to an open position, fully opening the present stack entrance 32 and the non-present stack entrance 34. Lower detent surfaces 76 of the detent blocks 70 prevent any further rearwards movement of the pawls 60 and n-shaped frame 62.

It will now be appreciated that once the purged banknote container 10 has been fully inserted into the dispenser, the diverter entrance 30, the present stack entrance 32, and the non-present stack entrance 34 are fully open.

Referring again to FIG. 2, the purged banknote container 10 also includes an articulated divider 80 having a first portion (the diverter separator) 82 coupled between the lower surface 14 and the middle upper surface 20, and a second portion (the purge separator) 84 extending from part-way along the first portion to the upper surface 24. The articulated divider 80 creates three compartments within the purged media container 10, namely: a diverter compartment 86, a present purge compartment 88, and a non-present purge compartment 90.

The diverter separator 82 is pivotably coupled to the middle upper surface 20 and coupled to the lower surface 14 by a snap-fit connector (not shown). The purge separator 84 is hingeably coupled to the diverter separator 82 and coupled to the upper surface 24 by a snap-fit connector (not shown). The purge separator 84 can be removed from the diverter separator 82 if desired.

Figure 7:
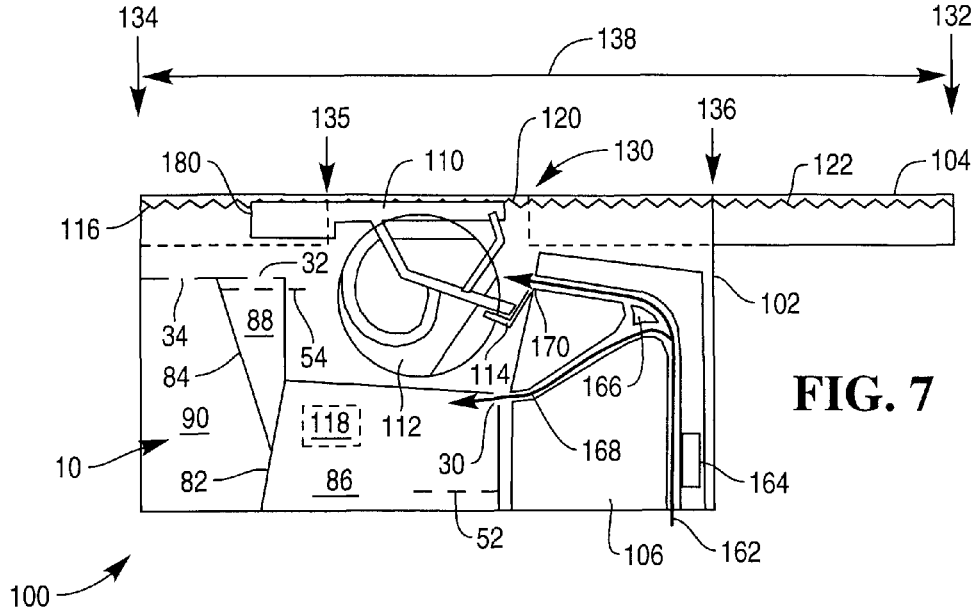
FIG. 7 is a schematic side view of a media presenter including the media container of FIG. 1.

The use of this three compartment container 10 will now be described with reference to FIG. 7, which is a simplified schematic side view of a media presenter 100 in the form of a banknote presenter.

The banknote presenter 100 comprises: a chassis 102, a removable nose 104, a banknote transport unit 106 for coupling to a pick unit (not shown) of a dispenser (not shown), the three compartment purge container 10, a carriage 110, a cam block 112, a registration device 114, a removable track 116, and a control board (shown by dotted line 118).

The chassis 102 includes a central track 120 located on an upper area thereof. The removable nose 104 includes a nose track 122 extending from a coupling end 130 of the nose 104 to a presenting end 132 of the nose 104, and aligning with the central track 120 to provide a continuous track. The removable track 116 is located at a non-presenting end (referred to herein as the blank end) 134 of the chassis 102. The blank end 134 is the end opposite the end of the chassis 102 from which the nose 104 extends (referred to herein as the nose end 136). The distance between the coupling end 130 and the nose end 136 is approximately equal to the length of the removable track 116.

The removable track 116, the central track 120, and the nose track 122 are all linearly aligned and coupled so that they combine to provide a presenting track (illustrated by arrow 138) extending from the blank end 134 of the chassis 102 to the presenting end 132 of the nose 104. The carriage 110 is linearly moveable along the length of the presenting track 138.

Although only one presenting track 138 is illustrated, the presenter 100 includes two removable tracks 116 and two central tracks 120, and the removable nose 104 includes two nose tracks 122, so that the chassis 102 includes two parallel presenting tracks 138, each located on an opposite side of the chassis 102. The carriage 110 simultaneously engages with both presenting tracks 138 (each of two opposing sides of the carriage 110 engages with a different one of the presenting tracks 138). However, for clarity only one presenting track 138 is illustrated in FIG. 7.

Figure 8A:
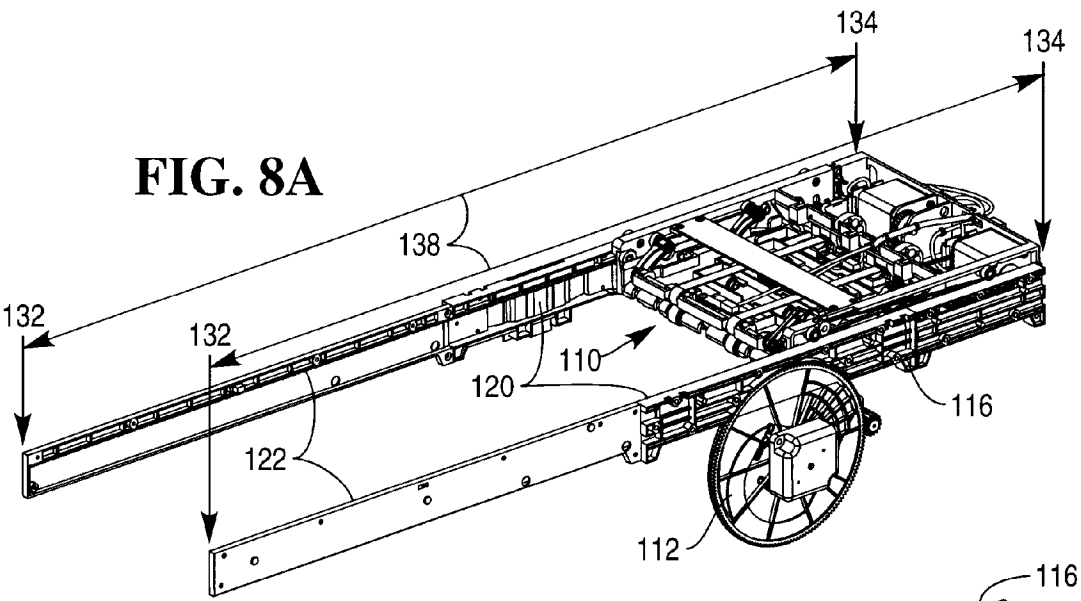
FIGS. 8A to 8E are diagrams illustrating parts (the presenting track, the cam block, and the carriage) of the media item presenter of FIG. 7 in five different positions.
Figure 8B:
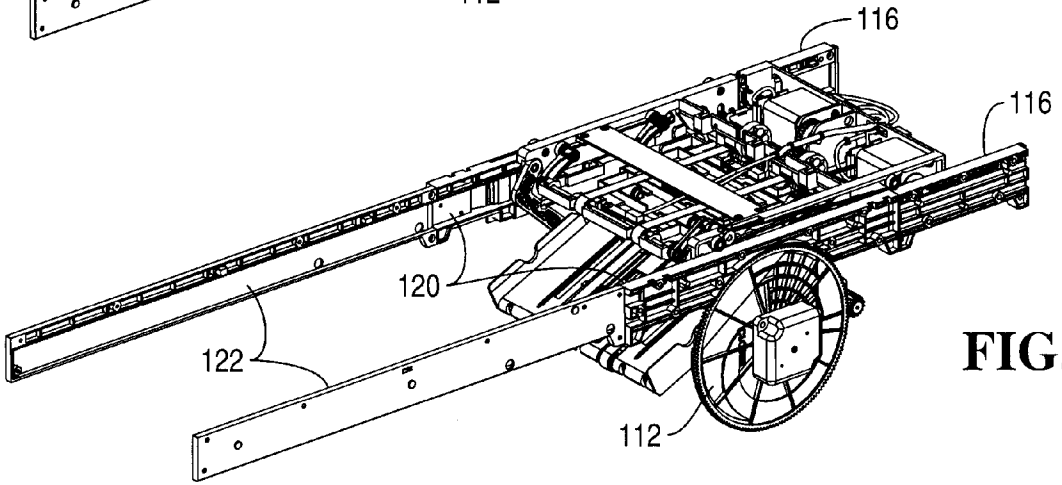
Figure 8C:
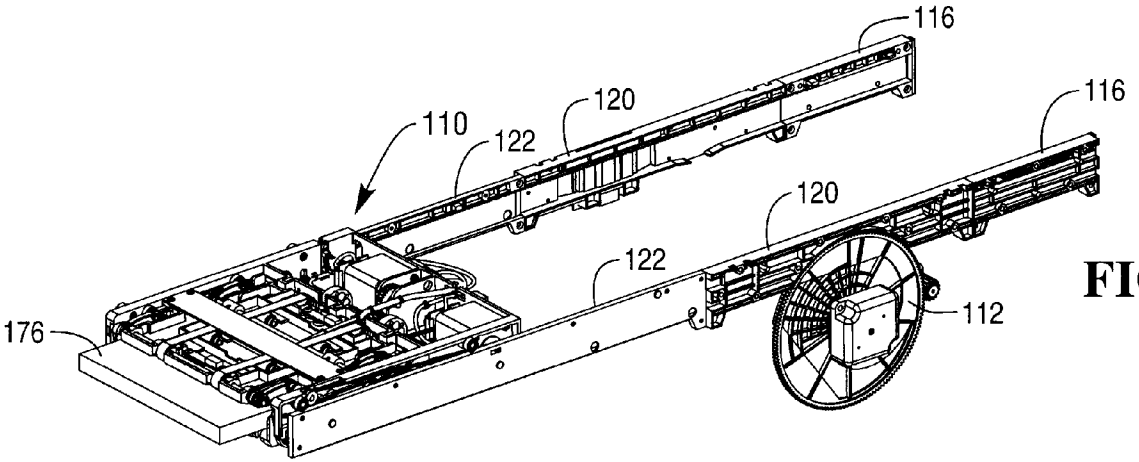
Figure 8D:
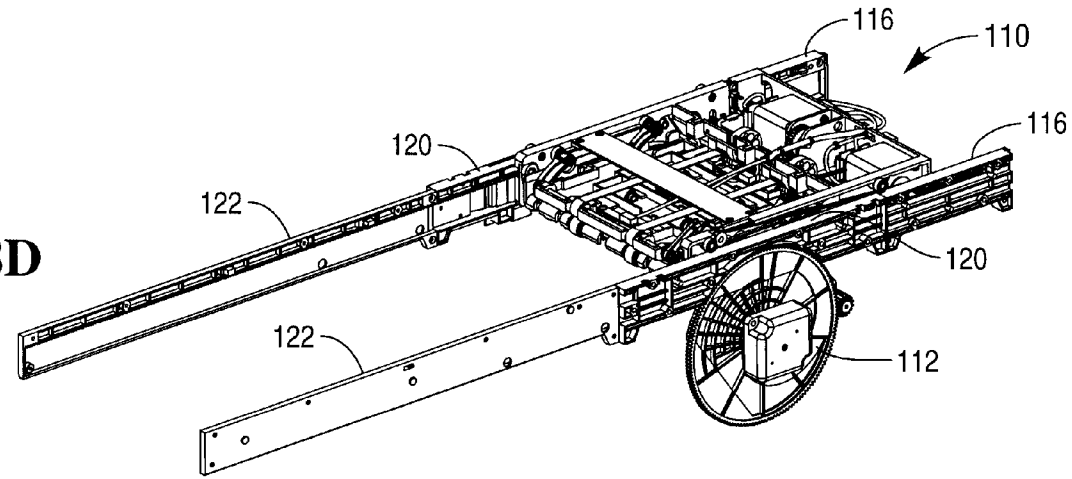
Figure 8E:
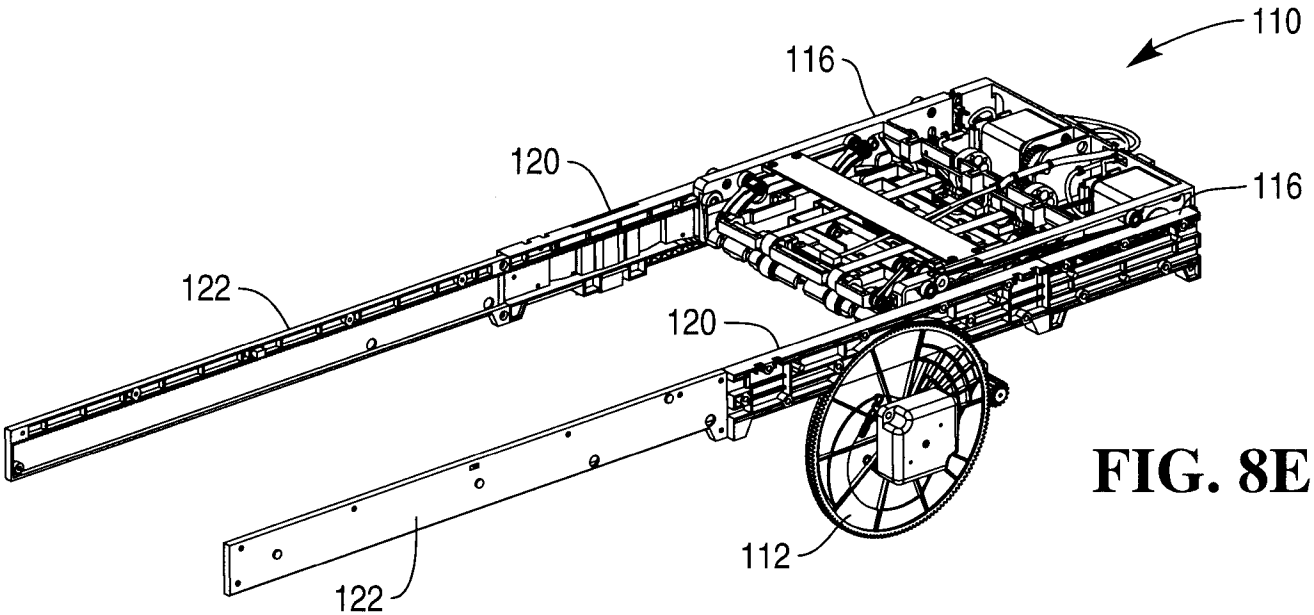

Reference will now also be made to FIGS. 8A to 8E, which illustrate the presenting track 138, the cam block 112, and the carriage 110 in five different positions. The five positions are: loading position, carriage closed (FIG. 8A); loading position, carriage open (FIG. 8B); present position (FIG. 8C); present purge position (FIG. 8D); and non-present purge position (FIG. 8E).

FIGS. 8A to 8E show the presenting track 138 (formed by the nose track 122, the central track 120, and the removable track 116), the cam block 112, and the carriage 110 mounted on the presenting track 138 for linear movement therealong.

The non-present purge position (FIG. 8E) is used for transporting a bunch of banknotes into the purged banknote container 10, where the bunch of banknotes was never presented to a customer. In contrast, the present purge position (FIG. 8D) is used for transporting a bunch of banknotes into the purged banknote container 10, where the bunch of banknotes was presented to a customer but was not removed by the customer, as will be described in more detail below.

FIG. 8A shows the carriage 110 at the loading position with the carriage 110 in the closed position. To load banknotes into the carriage 110, the carriage 110 is opened (as shown in FIG. 8B). The banknote transport unit 106 then loads banknotes into the carriage 110 along a main banknote path 162.

The banknote transport unit 106 includes a conventional banknote (note) thickness sensor (NTS) 164 to sense the thickness of each banknote being transported, and to detect any skew of a banknote being transported. The banknote transport unit 106 also includes a divert gate 166. The divert gate 166 is activated to divert any banknote failing the banknote thickness sensor test (implemented by the NTS 164) along a divert path 168, through the diverter entrance 30 of container 10, and into the diverter compartment 86.

A banknote may fail the banknote thickness sensor test, for example, because multiple banknotes are being transported as a single banknote, because a banknote has an unacceptably large hole, or because a banknote is skewed beyond an acceptable amount.

If a banknote is not diverted from the main transport path 162 then it is ejected from an exit port 170 of the main banknote path 162 onto the carriage 110. This continues until all of the required banknotes have been loaded onto the carriage 110 as a bunch. The carriage 110 can then be closed by rotating the cam block 112.

The bunch of banknotes is then presented to a customer. This is implemented by moving the carriage 110 to the present position (FIG. 8C). When the carriage 110 has reached the present position (as confirmed by position sensors (not shown)), then carriage 110 transports the bunch 176 of banknotes partially out for removal by a customer.

If the customer removes the banknote bunch then the carriage 110 moves back to the loading position, as shown in FIG. 8A.

If the customer does not remove the banknote bunch (or only removes some of the banknotes in the bunch) then the bunch 176 of banknotes is pulled back into the carriage 110. The control board 118 then moves the carriage 110 to the present purge position (FIG. 8D).

When at the present purge position, the carriage 110 transports the bunch 176 of banknotes into the present purge compartment 88.

In this embodiment there is a second purge position (the non-present purge position, as shown in FIG. 8E), which is closer to the blank end 134 than the present purge position. This is used for any purge operations in which the bunch of banknotes is never presented to a customer (and therefore there was no possibility of customer fraud).

The carriage 110 is located at the second purge position when a non-entrance end 180 (FIG. 7) of the carriage 110 is aligned with the non-present stack entrance 34 above the non-present purge compartment 90.

There are a number of reasons why the non-present purge compartment 90 may be used. For example, if insufficient banknotes are available to complete a bunch of banknotes, if there is a power fail during a stacking operation, if the single banknote purge compartment 86 is full and a transported banknote in the banknote transport unit 106 needs to be diverted to the purged banknote container 10, if a customer cancels the transaction before the bunch is presented, if there is a fault with one of the components and an auto-recovery process needs to be implemented, or if there is an attempted fraud prior to presenting the bunch.

During a routine replenishment operation, or if the purged banknote container 10 is full, a replenisher can rack out the purged banknote container 10. Racking out the purged banknote container 10 causes: (i) the diverter entrance 30 to be closed by the lower toothed tines 52 returning the arcuate entrance shutter 40 to the closed position, and (ii) the present stack entrance 32 and the non-present stack entrance 34 to be closed by the upper tines 54 returning the pawls 60 and n-shaped frame 62 to the closed position.

The purged banknote container 10 can then be carried without mixing of the contents from the three different compartments 86,88,90. Access to the contents of the purged banknote container 10 is provided by undoing the clasp 38 and opening the access door 36. This allows a replenisher to access banknotes in the non-present compartment 90; that is, banknotes purged without being presented. Once these have been removed and counted, the purge separator 84 of the articulated divider 80 can be flipped downwards (from upper surface 24) to gain access to banknotes in the present purge compartment 88; that is, banknotes purged after being presented to a customer. Once these have been removed and counted, the diverter separator 82 (and the purge separator 84 connected thereto) can be pivoted upwards to gain access to banknotes in the diverter compartment 86; that is, banknotes purged during stacking of a bunch of banknotes.

By having separate compartments for bunches of banknotes that were purged because they were not removed by customers, and bunches that were purged because of an internal problem with the cash dispenser, it is easier to identify and reconcile those transactions that were possibly due to customer fraud (that is, the customer removing some but not all banknotes in a bunch). This has the advantage of segregating banknotes purged after presenting from all other banknotes that have been purged.

Figure 9:
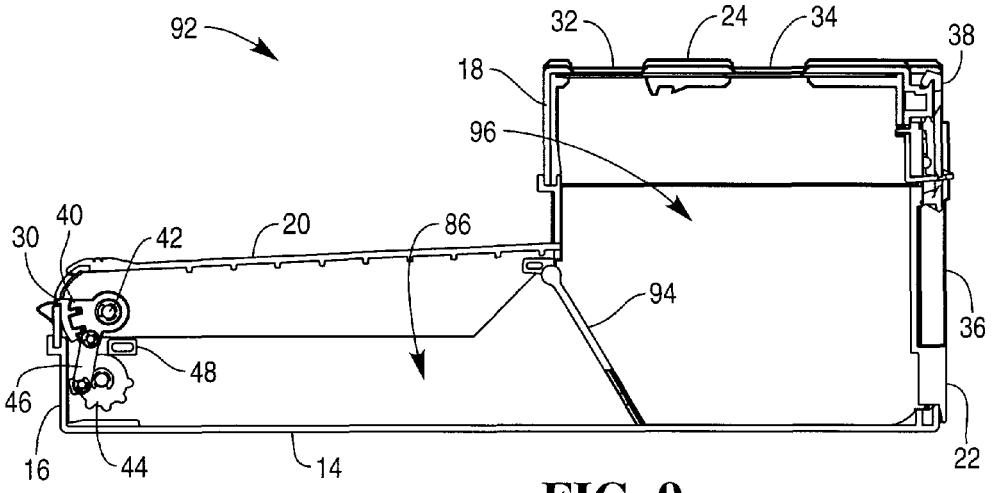
FIG. 9 is a side view of a media container according to another embodiment of the present invention.

An alternative embodiment, almost identical to that of FIGS. 1 to 6, is shown in FIG. 9. This alternative embodiment comprises a two compartment purged banknote container 92. The only difference between container 10 and container 92 is that a straight divider 94 is used in container 92 instead of the articulated divider 80 that is used in container 10. As a result, container 92 only has two compartments: the diverter compartment 86 and a purge compartment 96. The straight divider 94 may actually be the diverter separator 82 (that is, the FIG. 9 embodiment may be created by removing the purge separator 84 from the FIG. 2 embodiment).

Various modifications may be made to the above described embodiment within the scope of the invention, for example, in other embodiments, the presenter may be used for media items other than banknotes, such as coupons, tickets, passes, vouchers, or the like.

In other embodiments, the purge separator 84 may be biased to the lower surface 14 by a resilient member, such as a spring, to ensure that if the purge separator is not coupled to the upper surface 24 by the snap-fit connector then the resilient member will ensure that the purge separator 84 protrudes out of the access aperture in the rear surface 22, thereby preventing the access door 36 from being closed.

Similarly, in other embodiments, the straight divider 94 may be biased to the lower surface 14 by a resilient member, such as a spring.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A removable media container for use in a media dispenser, the media container comprising:

a diverter entrance for receiving diverted media items prior to stacking of the media items;

a non-present stack entrance for receiving a stack of media items subsequent to stacking of the media items but prior to presentation of the stack of media items to a customer; and a present stack entrance for receiving a stack of media items subsequent to presentation of the stack of media items to a customer;

wherein each of the non-present stack entrance and the present stack entrance comprises an aperture, and the non-present and present stack entrances are separated by a distance approximately equal to the width of each of the non-present and present apertures.

2. A removable media container according to claim 1, further comprising:

a diverter entrance shutter pivotably mounted within the container and biased to a closed position;

a detent to maintain the diverter entrance shutter in the closed position;

a channel for receiving a tine when the container is mounted in a media presenter; and a cog coupled to the diverter entrance shutter by a link arm, and aligned with the channel so that when a tine is received in the channel, the cog is operable to drive the diverter entrance shutter to an open position.

3. A removable media container according to claim 2, further comprising a second channel, parallel to the first channel, and for receiving a tine when the container is mounted in a media presenter; and a second cog coupled to the diverter entrance shutter by a second link arm, and aligned with the second channel so that when a tine is received in each channel, the cogs are operable to drive the diverter entrance shutter to an open position.

4. A removable media container according to claim 1, wherein the container further comprises a frame, slideably mounted in an upper surface of the container, the frame defining a non-present slot dimensioned to correspond to the width of the non-present aperture and defined on each side by plates, one of the plates being at least as wide as the width of the non-present aperture so that when the plate is biased to a closed position, both of the non-present and present apertures are closed by the frame, but when the frame is urged to an open position, the non-present aperture aligns with the non-present slot, and an edge of the frame is located beneath the area between the non-present aperture and the present aperture.

5. A removable media container according to claim 4, wherein the media container includes a pawl pivotably coupled to the frame.

6. A removable media container according to claim 5, wherein the container further comprises a detent block laterally offset from the pawl.

7. A removable media container according to claim 1, wherein the media container comprises a split-level housing defining a lower surface, a middle upper surface extending opposite a first part of the lower surface, and an upper surface extending opposite a second part of the lower surface, and the container further comprises a divider coupled between the middle upper surface and the lower surface, separating a diverter compartment defined by the lower surface and the middle upper surface, from a purge compartment defined by the lower surface and the upper surface.

8. A removable media container according to claim 1, wherein the media container comprises a split-level housing defining a lower surface, a middle upper surface extending opposite a first part of the lower surface, and an upper surface extending opposite a second part of the lower surface, and the container further comprises a three-way divider comprising (i) a first portion coupled between the middle upper surface and the lower surface, and (ii) a second portion coupled between the first portion and the upper surface at a point between the non-present entrance and the present entrance, thereby providing a diverter compartment, a present purge compartment, and a non-present purge compartment.

9. A removable media container according to claim 8, wherein the second portion is removably coupled to the first portion, so that the second portion can be removed to create a single purge compartment.

10. A removable media container according to claim 8, wherein the media container further comprises:

an access door opposite the diverter entrance and operable to close an access door aperture; and a warning mechanism operable to prevent the access door from closing in the event that the second portion is not coupled to the upper surface.

11. A removable media container according to claim 10, wherein the second portion comprises a length exceeding the distance between (i) the access door aperture, and (ii) a point at which the second portion is coupled to the first portion, so that if the second portion is not coupled to the upper surface then the second portion protrudes beyond the access door aperture so that the access door cannot be located in position.

12. A removable media container for use in a media dispenser, the media container comprising:

a diverter entrance for receiving diverted media items prior to stacking of the media items;

a non-present stack entrance for receiving a stack of media items subsequent to stacking of the media items but prior to presentation of the stack of media items to a customer;

a present stack entrance for receiving a stack of media items subsequent to presentation of the stack of media items to a customer;

a diverter entrance shutter pivotably mounted within the container and biased to a closed position;

a detent to maintain the diverter entrance shutter in the closed position;

a channel for receiving a tine when the container is mounted in a media presenter; and a cog coupled to the diverter entrance shutter by a link arm, and aligned with the channel so that when a tine is received in the channel, the cog is operable to drive the diverter entrance shutter to an open position.

13. A removable media container for use in a media dispenser, the media container comprising:

a diverter entrance for receiving diverted media items prior to stacking of the media items;

a non-present stack entrance for receiving a stack of media items subsequent to stacking of the media items but prior to presentation of the stack of media items to a customer; and a present stack entrance for receiving a stack of media items subsequent to presentation of the stack of media items to a customer;

wherein the media container comprises a split-level housing defining a lower surface, a middle upper surface extending opposite a first part of the lower surface, and an upper surface extending opposite a second part of the lower surface, and the container further comprises a divider coupled between the middle upper surface and the lower surface, separating a diverter compartment defined by the lower surface and the middle upper surface, from a purge compartment defined by the lower surface and the upper surface.

14. A removable media container for use in a media dispenser, the media container comprising:

a diverter entrance for receiving diverted media items prior to stacking of the media items;

a non-present stack entrance for receiving a stack of media items subsequent to stacking of the media items but prior to presentation of the stack of media items to a customer; and a present stack entrance for receiving a stack of media items subsequent to presentation of the stack of media items to a customer;

wherein the media container comprises a split-level housing defining a lower surface, a middle upper surface extending opposite a first part of the lower surface, and an upper surface extending opposite a second part of the lower surface, and the container further comprises a three-way divider comprising (i) a first portion coupled between the middle upper surface and the lower surface, and (ii) a second portion coupled between the first portion and the upper surface at a point between the non-present entrance and the present entrance, thereby providing a diverter compartment, a present purge compartment, and a non-present purge compartment.

* * * * *